US005279442A

United States Patent [19]

Jentzsch et al.

[11] Patent Number: 5,279,442

[45] Date of Patent: Jan. 18, 1994

[54] DRAWN AND IRONED CONTAINER AND APPARATUS AND METHOD FOR FORMING SAME

[75] Inventors: K. Reed Jentzsch; Terre R. Reingardt, both of Arvada, Colo.

[73] Assignee: Ball Corporation, Muncie, Ind.

[21] Appl. No.: 809,800

[22] Filed: Dec. 18, 1991

[51] Int. Cl.[5] ..... B65D 1/44

[52] U.S. Cl. ..... 220/671

[58] Field of Search ..... 220/671

[56] References Cited

U.S. PATENT DOCUMENTS

| | | | |
|---|---|---|---|
| D. 27,381 | 7/1897 | Pendleton, Jr. . | |
| D. 75,903 | 7/1928 | Dupiech . | |
| D. 110,882 | 6/1938 | Smith . | |
| D. 193,158 | 7/1962 | Buonauro . | |
| D. 200,792 | 4/1965 | Eyles . | |
| D. 201,400 | 6/1965 | Kneeland . | |
| D. 218,593 | 9/1970 | Hart | D9/7 |
| D. 249,121 | 8/1978 | Strand | D9/101 |
| D. 254,714 | 4/1980 | Mascia et al. | D9/163 |
| D. 257,314 | 10/1980 | Robison et al. | D7/70 |
| D. 262,439 | 12/1981 | Atkinson et al. | D9/351 |
| D. 263,024 | 2/1982 | Atkinson et al. | D9/351 |
| D. 263,450 | 3/1982 | Dutcher et al. | D9/430 |
| D. 275,834 | 10/1984 | Slade | D9/355 |
| D. 283,011 | 3/1986 | Moloney et al. | D9/398 |
| D. 285,534 | 9/1986 | Itoh et al. | D9/365 |
| D. 289,736 | 5/1987 | Bowers, Jr. | D9/368 |
| D. 290,688 | 7/1987 | Moloney et al. | D9/398 |
| D. 306,972 | 4/1990 | Moloney et al. | D9/398 |
| 28,014 | 4/1860 | Scaife . | |
| 42,949 | 5/1864 | Johnson, Jr. et al. . | |
| 140,527 | 7/1873 | Munson, Jr. . | |
| 205,946 | 7/1878 | Brougham . | |
| 354,573 | 12/1886 | Norton . | |
| 423,833 | 3/1890 | Stiveson et al. . | |
| 535,566 | 3/1895 | Waterson . | |
| 606,856 | 7/1898 | Campel . | |
| 643,743 | 2/1900 | Harris . | |
| 664,185 | 12/1900 | Stran . | |
| 744,231 | 11/1903 | Puddefoot . | |
| 756,406 | 4/1904 | Puddefoot et al. . | |
| 1,014,491 | 1/1912 | Lamine . | |
| 1,249,606 | 12/1917 | Eaton . | |
| 1,262,289 | 4/1918 | Weber . | |
| 1,352,813 | 9/1920 | Kennicott et al. . | |
| 1,402,830 | 1/1922 | Boyle, Sr. . | |
| 1,454,802 | 5/1923 | Wells . | |
| 2,005,641 | 6/1935 | Stanitz et al. | 220/72 |
| 2,059,292 | 11/1936 | Taylor | 153/2 |
| 2,061,034 | 11/1936 | Lennon | 153/70 |
| 2,063,013 | 12/1936 | Cooper | 220/72 |
| 2,139,143 | 12/1938 | Wiswell | 221/47.3 |
| 2,869,753 | 1/1959 | Jankowski | 220/671 |
| 2,974,824 | 3/1961 | Mansino | 220/53 |

(List continued on next page.)

*Primary Examiner*—Joseph Man-Fu Moy
*Attorney, Agent, or Firm*—Gilbert E. Alberding

[57] ABSTRACT

A drawn and ironed container body is provided having a plurality of alternating inward and outward segments around the circumference of the stripper bulge and extending through at least a portion of the longitudinal extent of the bulge whereby the minimum column strength of a sampling of such containers is substantially increased. An apparatus for reforming a drawn and ironed container body is also provided, comprising inner and outer members positionable in opposing relation with each other, with at least a portion of the bulge positioned therebetween, the inner and outer members being capable of radial movement relative to each other to form alternating inward and outward segments around the circumference of the bulge and extending through at least a portion of the longitudinal extent thereof. In one embodiment, the inner member is a mandrel for supporting container body and secured to a circular turret and the outer member comprises an arcuate member having a rigid plate and a resilient layer for contacting a portion a container body on the mandrel. As the container simultaneously rotates about its longitudinal axis and revolves around the center axis of the turret, compressive force against the resilient layer forces metal to conform to inward and outward segments in the mandrel.

18 Claims, 9 Drawing Sheets

U.S. PATENT DOCUMENTS

| | | | |
|---|---|---|---|
| 3,094,240 | 6/1963 | Wanderer | 220/97 |
| 3,150,707 | 9/1964 | Howell | 153/7 |
| 3,156,383 | 11/1964 | Melli | 222/83 |
| 3,194,468 | 7/1965 | Baron | 229/1.5 |
| 3,306,488 | 2/1967 | Lemelson | 220/63 |
| 3,317,110 | 5/1967 | Palmer | 229/5.5 |
| 3,335,902 | 8/1967 | Javorik | 220/72 |
| 3,357,593 | 12/1967 | Sears, Jr. et al. | 220/72 |
| 3,401,826 | 9/1968 | Anthony | 220/72 |
| 3,402,871 | 9/1968 | Palmer | 229/3.5 |
| 3,407,638 | 10/1968 | Greis et al. | 72/96 |
| 3,443,715 | 5/1969 | Edwards | 220/671 |
| 3,459,028 | 8/1969 | Bijvoet | 72/393 |
| 3,495,736 | 2/1970 | Ragettli | 220/72 |
| 3,503,310 | 3/1970 | Goetz | 93/94 |
| 3,558,001 | 1/1971 | Fritz et al. | 220/67 |
| 3,563,408 | 2/1971 | Bijvoet | 220/83 |
| 3,593,552 | 7/1971 | Fraze | 72/83 |
| 3,690,507 | 9/1972 | Gailus et al. | 220/66 |
| 3,759,203 | 9/1973 | Frankenberg | 113/1 G |
| 3,904,069 | 9/1975 | Toukmanian | 220/66 |
| 3,910,414 | 10/1975 | McCay | 206/515 |
| 3,918,603 | 11/1975 | Hatada | 220/1 R |
| 4,059,000 | 11/1977 | Bodnar | 72/197 |
| 4,125,187 | 11/1978 | Vecchiotti | 220/671 |
| 4,134,510 | 1/1979 | Chang | 215/1 |
| 4,140,236 | 2/1979 | Uhlig et al. | 220/71 |
| 4,169,537 | 10/1979 | Sabreen et al. | 220/70 |
| 4,245,685 | 1/1981 | Nemitz et al. | 150/52 R |
| 4,266,685 | 5/1981 | Lee, Jr. | 220/74 |
| 4,316,375 | 2/1982 | Lee, Jr. | 72/105 |
| 4,324,340 | 4/1982 | Belokin, Jr. | 220/1 |
| 4,487,048 | 12/1984 | Frei | 72/94 |
| 4,512,490 | 4/1985 | Frei et al. | 220/72 |
| 4,538,439 | 9/1985 | Frei | 72/105 |
| 4,578,976 | 4/1986 | Shulski et al. | 72/105 |
| 4,723,681 | 2/1988 | Glerum | 220/671 |
| 4,732,292 | 3/1988 | Supik | 220/70 |
| 4,872,576 | 10/1989 | Nakamura | 220/83 |
| 4,890,757 | 1/1990 | Robbins, III | 220/72 |
| 4,909,393 | 3/1990 | Palisin, Jr. | 206/519 |
| 4,953,738 | 9/1990 | Stirbis | 220/606 |
| 5,022,254 | 6/1991 | Kramer | 72/393 |
| 5,040,682 | 8/1991 | Palisin, Jr. et al. | 206/519 |
| 5,040,698 | 8/1991 | Ramsey et al. | 220/671 |
| 5,048,977 | 9/1991 | Robbins, III | 383/104 |
| 5,071,060 | 12/1991 | DeFelice | 229/1.5 B |
| 5,100,017 | 3/1992 | Ishinabe et al. | 220/669 |
| 5,160,031 | 11/1992 | Palisin, Jr. et al. | 206/519 |

FOREIGN PATENT DOCUMENTS

| | | |
|---|---|---|
| 0097399 | 1/1984 | European Pat. Off. . |
| 594125 | 9/1925 | France . |
| 659630 | 2/1987 | Switzerland . |
| 889981 | 2/1962 | United Kingdom . |

DRAWN AND IRONED CONTAINER AND APPARATUS AND METHOD FOR FORMING SAME

TECHNICAL FIELD OF THE INVENTION

The present invention relates to drawn and ironed containers and, in particular, a drawn and ironed container, and apparatus and method for making the same, with improved column strength characteristics.

BACKGROUND OF THE INVENTION

Two-piece drawn and ironed metal containers, such as those used to contain carbonated beverages, have an integrated body/bottom piece and a separate top piece. The body includes a cylindrical sidewall section and a bottom support section upon which the container rests when upright. A typical pressurized aluminum beverage container also has a transition or rework taper section which connects the sidewall section, having one diameter, with the bottom section, having a smaller diameter.

A drawn and ironed container body is formed on a body maker which typically comprises a reciprocating punch, a redraw sleeve, a redraw die, one or more ironing rings, a compound doming die, and an air stripper. The nose of the punch engages the open end of a shallow, cup-like container blank. The cup is forced linearly by the punch through the redraw die to reduce its diameter and elongate the sidewalls. The punch then forces the redrawn cup through the series of ironing rings to gradually thin and further elongate the sidewalls. The punch then forces the bottom of the container against the compound doming die to form an inward dome and an annular support in the bottom section of the container. The punch and the completed container body reverse direction and the container is separated from the punch by a burst of compressed air, sometimes with the assistance of stripping fingers. The container body is then transported to be necked and flanged.

As the nose of the punch forces a container cup through the redraw die and ironing rings to thin and elongate the sidewall, metal is pulled around the nose of the punch along the side of the punch, leaving a slight annular, outward bulge where the metal bends in the rework taper section between the sidewall and bottom sections. The bulge can expand after the doming operation when compressed air is injected into the container to facilitate its removal from the punch. As will be discussed below, the bulge (sometimes known as the "stripper bulge") is thought to introduce weakness in the container.

The nose of the punch has a slight taper, known as the rework taper, having dimensions which define the thickness of the container wall in the rework taper section. This thickness has a significant influence on the axial load capacity, or column strength, of the completed container. The column strength of a container is a measure of the container's ability to resist compressive forces applied between the top and bottom of the container in a direction substantially parallel to the sidewall. To determine the column strength of a container body and to determine where it first fails when an excessive axial load is applied, the container body (without the top) is placed in an axial load tester with one end against a base plate. When the machine is turned on, the base plate and a second, parallel plate move toward each other, thus compressing the container body longitudinally between the two plates. The compressive force is automatically increased until the container fails, such as by collapsing. The force on the container at the time of failure is the column strength of the container and is read from a display on the machine.

Fillers and distributors, to whom empty, necked containers are sold, currently require that the empty containers have a column strength of at least 250 pounds. A container with insufficient column strength may fail by collapsing when subjected to normal axial loads of up to about 250 pounds, as might occur when containers are necked, filled or seamed. In the past, gauges of metal, such as aluminum alloy with a thickness of 0.0120 inches (12.0 mils) or greater were employed and the strength requirements were readily attainable.

However, in order to reduce the amount of metal used in a container, and to thus reduce production costs and consumption of energy and raw materials, containers have been downgauged in recent years, such as to 11.8 mils and, more recently, to 11.6 mils. For the same reasons, still further downgauging is desired. Accompanying the downgauging has been a reduction in column strength and an increase in the number of container failures. Viewed statistically, both the average column strength and the minimum column strength of a sampling of aluminum alloy container bodies have declined to such an extent that, as set forth in Table 1, the minimum column strength is less than 250 pounds: not all containers in the sampling met the 250 pound requirement. A lack of uniformity in the containers in the sampling is demonstrated by the high standard deviation noted in Table 1.

TABLE 1

| NECKED COLUMN STRENGTH (11.6 mil gauge aluminum alloy) | |
|---|---|
| AVERAGE | 306 pounds |
| MINIMUM | 202 pounds |
| MAXIMUM | 338 pounds |
| STANDARD DEVIATION | 30 |

It can be expected that further downgauging will result in further undesirable decreases in the minimum and average column strength and an increase in the standard deviation unless offsetting measures are taken.

In addressing this problem, the present inventors have now recognized a possible relationship between the column strength of a container and the presence of surface defects and the stripper bulge. It is believed that minor defects which can develop in the surface during container processing, handling and shipping, such as small bumps and dents in the sidewall and elsewhere, can reduce the column strength of a container. It is also believed that the presence of the stripper bulge in the rework taper section can also contribute to reduced column strength. The present inventors believe that the thicker gauges of containers produced in the past (such as 12 mils or greater) have enabled the containers to better able to resist the formation of defects and the stripper bulge than one with a thinner gauge, and to better resist the effects of any defects or the stripper bulge which occurred.

As a result of the foregoing factors, a significant number of containers with thinner gauges than previously employed may fail to meet minimum column strength requirements, even though the average column strength of the containers in a sampling exceeds the requirement. It is, therefore, desirable to increase the uniformity of the containers in a sampling and to increase the minimum column strength of containers by decreasing the effects of the stripper bulge and surface defects and thereby enable the column strength requirement to be met by substantially all of the containers. It is also desirable to be able to meet the column strength requirement when further downgauging of the container body thickness is undertaken.

SUMMARY OF THE INVENTION

The present invention provides a drawn and ironed container having improved column strength characteristics, and an apparatus and method for producing the container. The container includes a plurality of alternating inward and outward segments spaced around the circumference of the stripper bulge and extending through at least a portion of the longitudinal extent of the bulge. In one embodiment, the segments extend longitudinally into the bottom of the sidewall section of the container. Preferably, adjacent inward and outward segments abut each other and are uniformly spaced around the circumference of the bulge. In another embodiment, the radius of curvature of the outward segments is greater than the radius of curvature of the inward segments, thus providing a surface less prone to abrasion.

An apparatus is also provided for reforming the stripper bulge of a drawn and ironed container by forming a plurality of alternating inward and outward segments in the bulge. The apparatus includes an inner member for supporting the peripheral portions of the container and an outer member positionable in opposing relation to the inner member, with at least a portion of the bulge positioned between the two. The inner and outer members are capable of radial movement relative to each other to form the inward and outward segments in the bulge. In one embodiment, the inner member comprises a mandrel, having a plurality of alternating inward and outward segments corresponding to the segments to be formed in the bulge, and the outer member comprises a rigid plate with an overlying layer of resilient material. The container is mounted on the mandrel and is rolled along the resilient layer so that each area of the bulge is momentarily in compressive contact with the resilient layer, deforming the resilient layer and forcing the metal of the bulge to conform to the segments in the mandrel. A circular turret device and an arcuate outer member can be employed for continually processing containers in rapid sequence.

A method is also provided for use in the production of drawn and ironed metal containers, comprising the steps of supporting selected peripheral portions of the container and forcing metal between the supported portions to form a plurality of alternating inward and outward segments around the circumference of the bulge. Preferably, the forcing step includes the substep of rolling the container along resilient material overlaying a rigid plate and pressing portions of the bulge against the resilient material.

Tests performed on a sampling of containers having alternating inward and outward segments formed in their bulges in accordance with the present invention demonstrate an increase in the minimum column strength of the containers so that all or substantially all of the containers have a column strength of at least 250 pounds. Increases in the minimum column strength can also be achieved by extending the segments into the sidewall section. Without wishing to be bound by any one theory, it is believed that the reformation of the sidewall section substantially irons out many defects caused during the original production of the container in the body maker, thereby reducing the detrimental effects of the defects and increasing column strength of the can.

Consequently, the container, apparatus and method of the present invention result in improved uniformity and permit the minimum column strength requirements to be met without increasing the thickness of the container sidewalls and should enable further downgauging to be achieved while maintaining satisfactory column strength.

DETAILED DESCRIPTION

Figure 1:
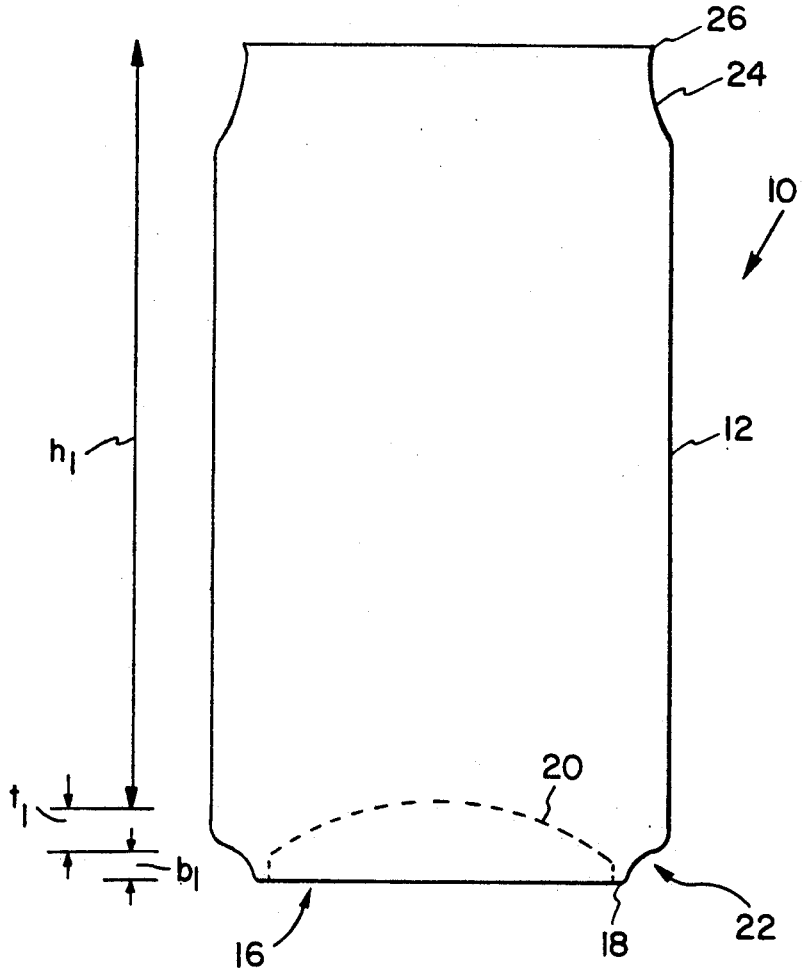
FIG. 1 PRIOR ART
FIG. 1 is a side view of a drawn and ironed container of the prior art.
Figure 2:
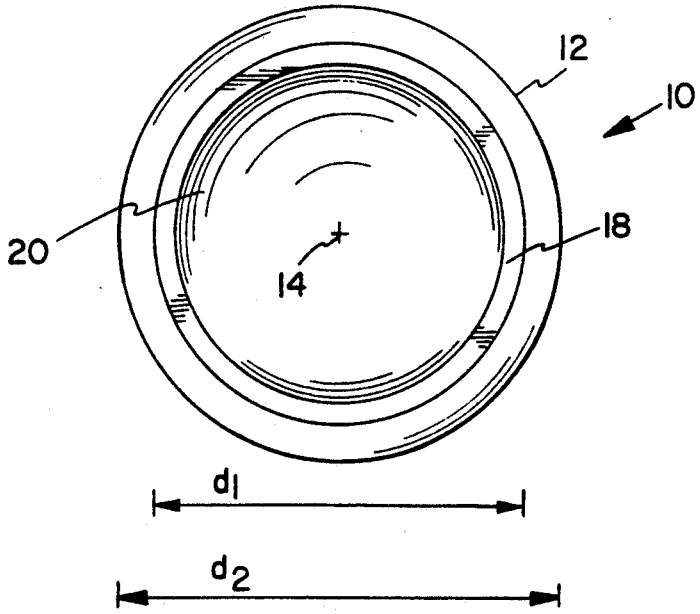
FIG. 2 PRIOR ART
FIG. 2 is a bottom view of the prior art container of FIG. 1.

FIGS. 1 and 2 are a side view and a bottom view, respectively, of a prior art, one-piece, drawn and ironed container body 10, such as might be used for carbonated beverages. The container body 10 is typically formed from an aluminum alloy, but can be formed from another metal. The container 10 includes a cylindrical sidewall section 12 surrounding a longitudinal center axis 14, and a bottom section 16 with an annular support 18, upon which the container body 10 rests when upright. The bottom section 16 typically includes a domed portion 20 (shown in phantom FIG. 1) to improve the container's resistance to internal pressures such as caused by carbonated beverages. The bottom section 16 of the container body 10 has a diameter $d_1$, which is less than the diameter $d_2$ of the sidewall 12. This facilitates stacking of filled containers one on top of the other and reduces the amount of metal required for the separate lid of the container 10.

Between the sidewall section 12 and the bottom section 16 is a rework taper section 22 which connects the sidewall section 12 with the bottom section 16. Due to the shape of the nose of the punch, the thickness of the metal gradually thins, or tapers, from the lower portion of the rework taper section 22 to the upper portion. Adjacent to the top of the sidewall section 12 are a necked portion 24 and a flanged portion 26 for receiving the lid.

One version of the container body 10 has a thickness of about 11.6 mils, a total height of about 4.8 inches, and a sidewall diameter $d_2$ of about 2.6 inches. The bottom section 16 has a height $b_1$ of about 0.1 inches, as measured upward from the base of the annular support 18 to the bottom of the rework taper section 22, and the annular support 18 has a diameter $d_1$ of about 2.0 inches. The sidewall section 12 and necked and flanged portions 24 and 26 have a total height $h_1$ of about 4.5 inches, as measured downward from the top of the flange portion 26 to the top of the rework taper section 22. The rework taper section 22 has a height $t_1$ of about 0.2 inches, as measured from the top of the bottom section 16 to the bottom of the sidewall section 12.

Figure 3:
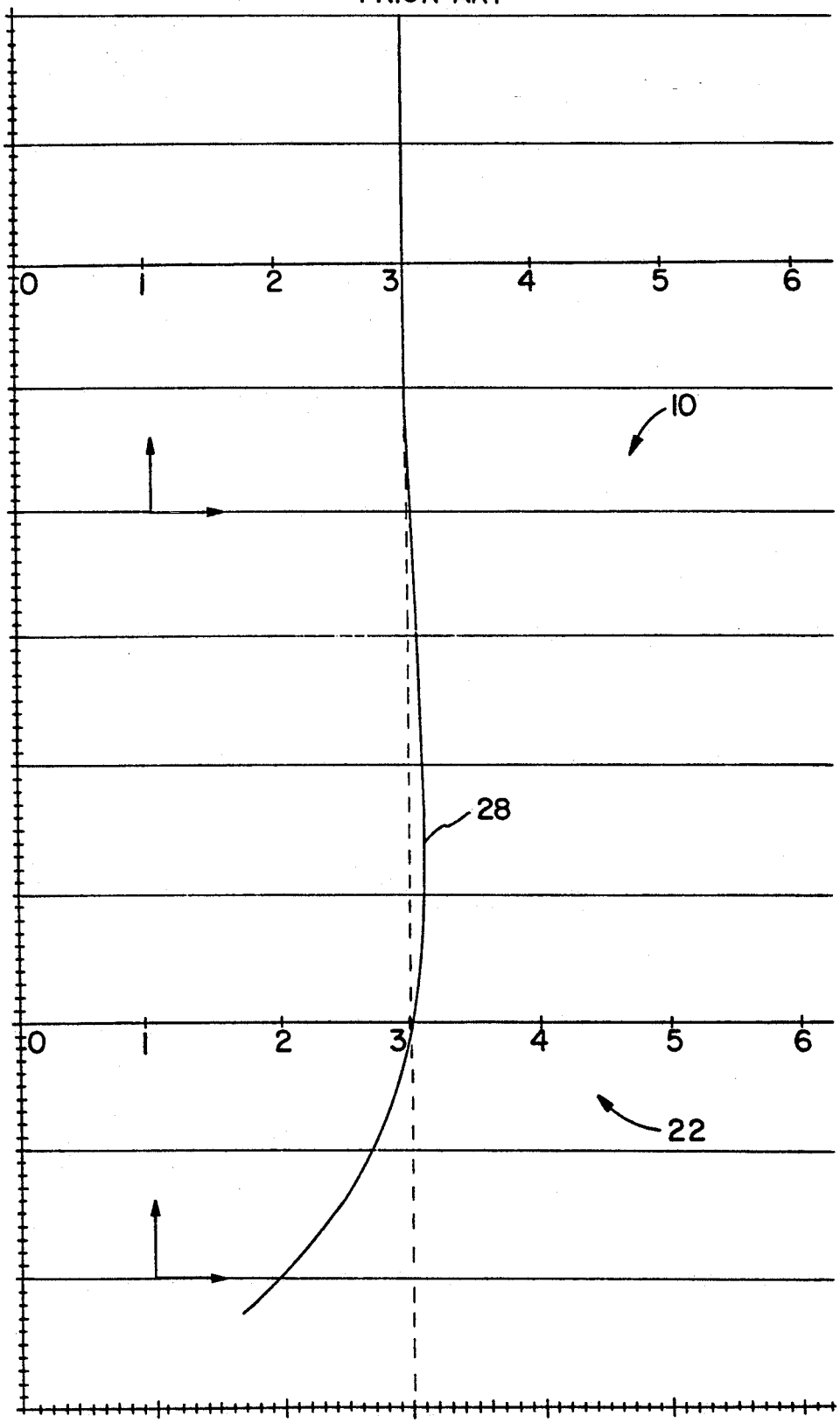
FIG. 3 PRIOR ART
FIG. 3 is a contrace of a portion of the rework taper section of the prior art container of FIG. 1.

FIG. 3 is a contrace or enlarged, longitudinal, cross-sectional view of a portion of the rework taper section 22 of the container body 10 illustrated in FIG. 1. An outward, annular stripper bulge 28 around the circumference of the rework taper section 22 is formed while the container blank is being processed in a body maker and forced by the punch through a series of drawing and ironing dies. The bulge 28 is particularly evident after the completed container body is stripped from the punch with a burst of compressed air. Typically, the bulge 28 is adjacent to the bottom of the sidewall section 12 and extends outwardly about 4–10 mils. Containers of thinner gauge generally have larger bulges than containers of thicker gauge.

As noted in conjunction with Table 1, even though the average column strength of the containers tested exceeded the 250 pound requirement, the minimum column strength was substantially less than 250 pounds indicating that a significant number of containers failed to meet the standard. From observations made during column strength testing, it is believed that a substantial number of such failures begin at or near the bulge 28. It is also believed that bumps, dents and other defects in the sidewall section 12 and elsewhere may contribute to reduced column strength of a container. Such defects can occur during production of a container in the bodymaker and/or afterward during further processing of the container body.

Figure 4:
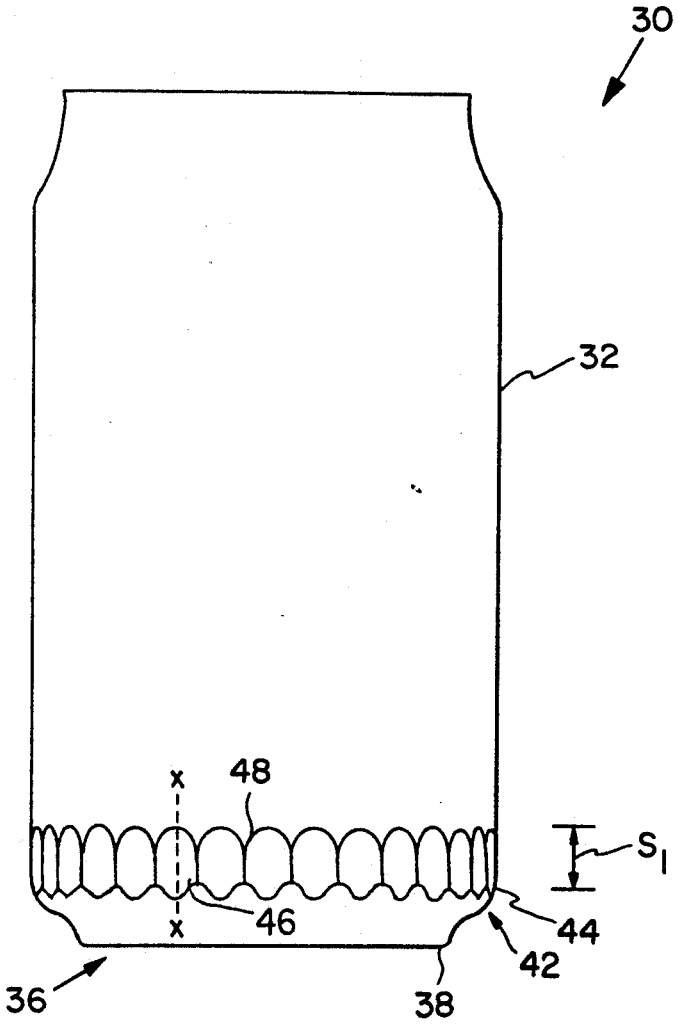
FIG. 4 is a side view of one embodiment of a container of the present invention.
Figure 5:
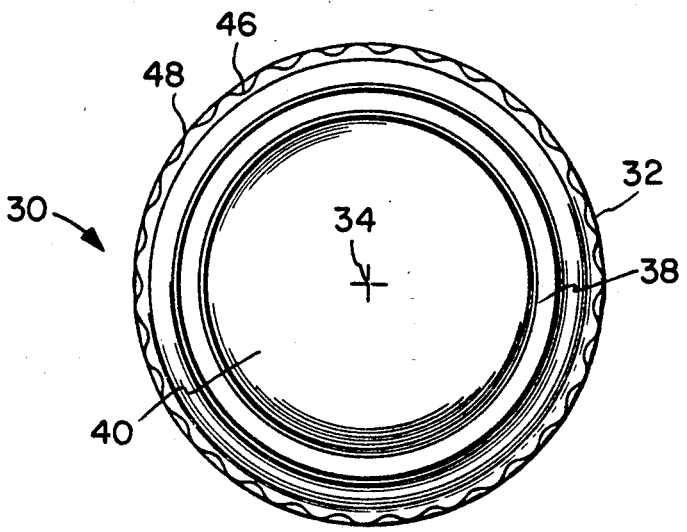
FIG. 5 is a bottom view of the container of FIG. 4.

The present invention provides a container body having a reformed bulge. FIGS. 4 and 5 are a side view and a bottom view, respectively, of one embodiment of a container body 30 of the present invention. The container body 30 includes a cylindrical sidewall section 32 surrounding a longitudinal center axis 34, and a bottom section 36 having an annular support 38 and a concave dome 40. The container body 30 also includes a rework taper section 42 having an annular, outward stripper bulge 44 around the circumference and adjacent to the bottom of the sidewall section 32.

Extending through at least a portion of the longitudinal extent of the bulge 44 are a plurality of alternating inward and outward segments 46 and 48, respectively, spaced around the circumference of the bulge 44. Although segments 46 and 48 are illustrated as having a curved or arcuate shape, they can be formed in other shapes instead such as, for example, triangular or rectangular. However, the arcuate shape is preferred because, inter alia, it is believed to provide a stronger container and a more acceptable "feel" to consumers.

Figure 6:
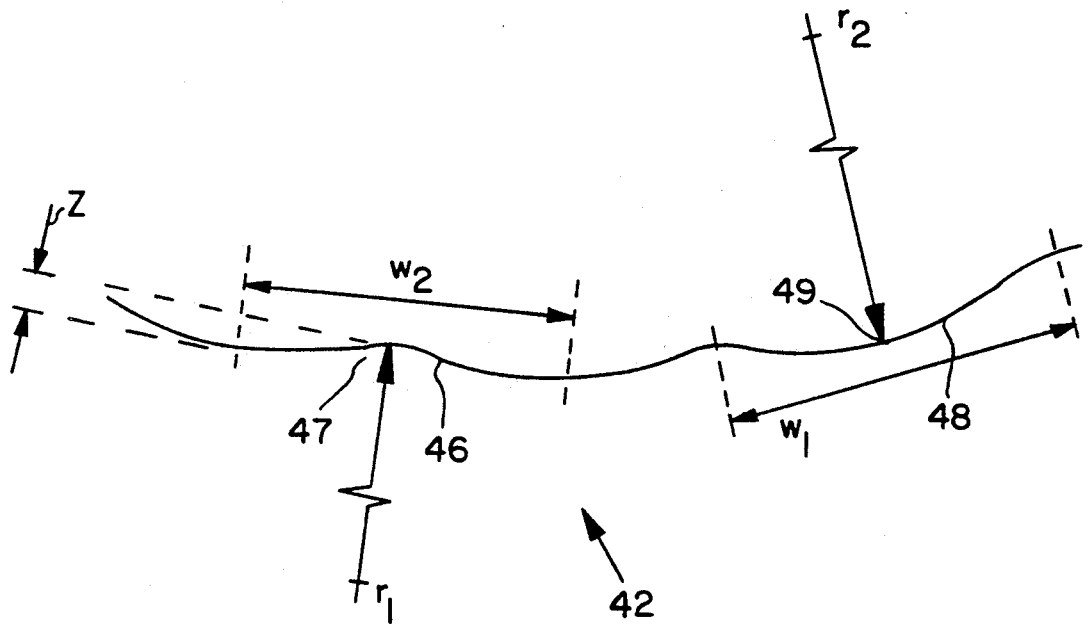
FIG. 6 is an enlarged cross-sectional view of a portion of the alternating segments in the bulge of the container of FIG. 5.

FIG. 6 is an enlarged cross-sectional view of a portion of the alternating segments 46 and 48 in the rework taper section 42 of the container body 30. In the embodiment illustrated in FIGS. 4–6, the inward and outward segments 46 and 48 are substantially uniformly spaced around the circumference of the bulge 44 and abut each other. Each also has a vertically oblong shape and is symmetrical across a longitudinal axis, such as axis x—x through the inward segment 46, which is substantially parallel to the center axis 34 of the sidewall 32. It can be appreciated that other configurations of the inward and outward segments 46 and 48 can also be employed.

The inward segment 46 is shown as being arcuate and has a radius of curvature $r_1$ measured at its inward-most point 47; the outward segment 48 is also shown as being arcuate and has a radius of curvature of $r_2$ measured at its outward-most point 49. The radius of curvature of a segment is the radius of a circle that would match the curvature of the segment at the point of measurement. Preferably, $r_2$ is sufficiently large, such as about 0.25 inches or larger, to give the outward segments 48 a relatively rounded and smooth feel. Selecting such a radius of curvature r: reduces the likelihood that the outward segments 48 will be abraded and dented during handling and shipping, particularly proximate to the outward-most point 49, which can occur when the outward segments 48 have a smaller radius of curvature $r_2$ and a "sharper" feel. Providing the outward segments 48 with a substantially constant radius of curvature $r_2$ (resulting in a substantially circular cross-section) also enhances the smoothness and reduces the sharpness of the segments 48. Additionally, the width $w_1$, of the outward segment 48 should be at least as great as the width $w_2$ of the inward segment 46 in order to enhance the smooth feel and reduce the potential for abrasion and other surface damage.

In one embodiment of the present invention, the dimensions of the container body 30 are substantially the same as the dimensions of the prior art container illustrated in FIGS. 1–3. Additionally, there are 30 inward arcuate segments 46 having a radius of curvature $r_1$ of about 0.30 inches and 30 outward arcuate segments 48 having a substantially constant radius of curvature $r_2$ of about 0.29 inches. The depth z between the inner-most point 47 of an inward segment 46 and the outer-most point 49 of an adjacent outward segment 48 is about 0.025 inches. The present invention is not limited to any particular depth and deeper or shallower segments can be formed. In the container body 30 illustrated in FIG. 4, the inward and outward segments 46 and 48 each have a length $s_1$ and extend longitudinally into the bottom of the sidewall section 32. In another embodiment, illustrated with respect to the container body 50 of FIG. 7, the inward and outward segments 52 and 54 can extend through substantially the entire longitudinal extent of the sidewall section 56 with a length $s_2$ to substantially iron out and remove sidewall defects, thereby further enhancing the column strength characteristics of the container.

Figure 7:
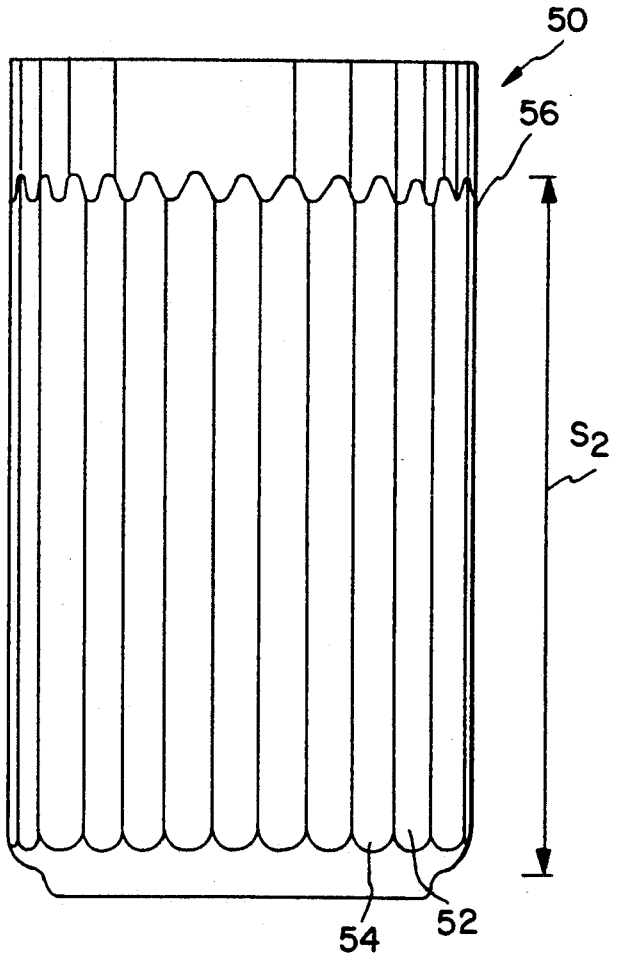
FIG. 7 is a side view of another embodiment of the container of the present invention.

The column strengths of a sampling of containers of the embodiment illustrated in FIG. 7 were measured in the manner previously described and the results are set forth in Table 2 (the data from Table 1 have been included for comparison):

TABLE 2

| | NECKED COLUMN STRENGTH (11.6 mil gauge aluminum alloy) | |
|---|---|---|
| | WITHOUT ARCUATE SEGMENTS | WITH ARCUATE SEGMENTS |
| AVERAGE | 306 pounds | 319 pounds |
| MINIMUM | 202 pounds | 298 pounds |
| MAXIMUM | 338 pounds | 336 pounds |
| STANDARD DEVIATION | 30 | 8 |

Figure 8:
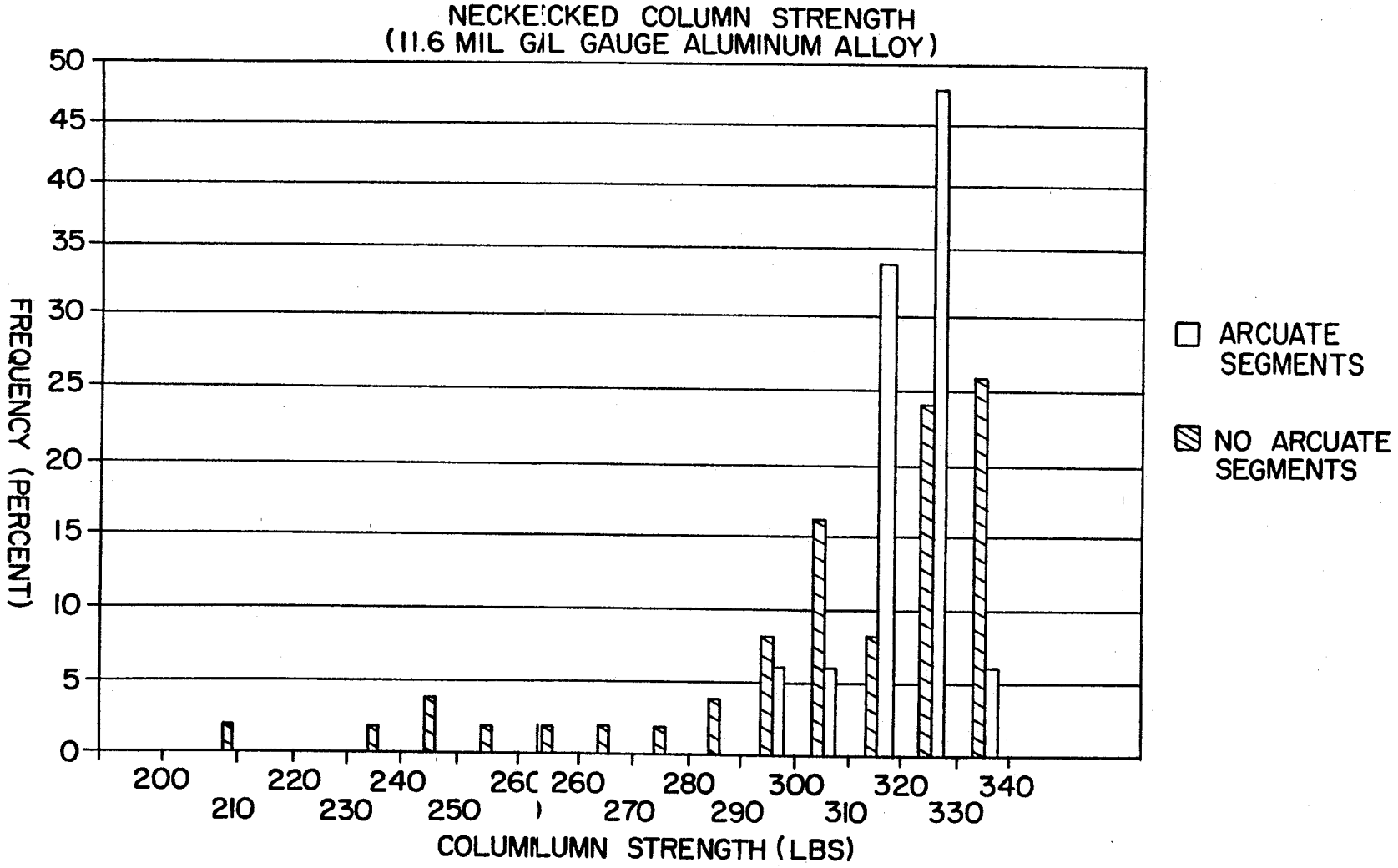
FIG. 8 is a histogram comparing the column strengths of prior art containers with containers reformed in accordance with the present invention.

Except for the formation of the inward and outward segments, no dimensions or other aspects of the containers were changed. It can be seen from Table 2 that the presence of inward and outward segments increases the minimum column strength of the containers tested from 202 pounds to 298 pounds, substantially above the 250 pound required minimum. Consequently, 100 percent of the container bodies tested having the segments met the requirement. It can also be seen from Table 2 that the standard deviation decreased drastically, thus indicating a substantial increase in the uniformity of the containers having the segments. FIG. 8 graphically illustrates the difference in column strengths due to the addition of the inward and outward arcuate segments and is based upon the data from which Table 2 was generated. All of the containers tested having segments formed in the bulge had a column strength in excess of 250 pounds (in fact, all had a column strength in excess of 298 pounds) while about 8% of the containers without such segments had a column strength less than 250 pounds.

The present invention also provides an apparatus for reforming the outward bulge in the rework taper section of a drawn and ironed container. The apparatus includes an inner member for supporting selected portions of the container, and an outer member positionable in opposing relation to the inner member, the inner and outer members being capable of relative radial movement therebetween. The container is mounted on the inner member and is rolled along the outer member with a compressive force, having a vector component substantially normal to a surface of the outer member, to form a plurality of alternating inward and outward segments around the circumference of the bulge. The outer member can be substantially flat, whereby the container and inner member are rolled linearly along the outer member, or can be arcuate, whereby the inner member and container are rolled in a corresponding arcuate manner along the outer member.

Figure 9A:
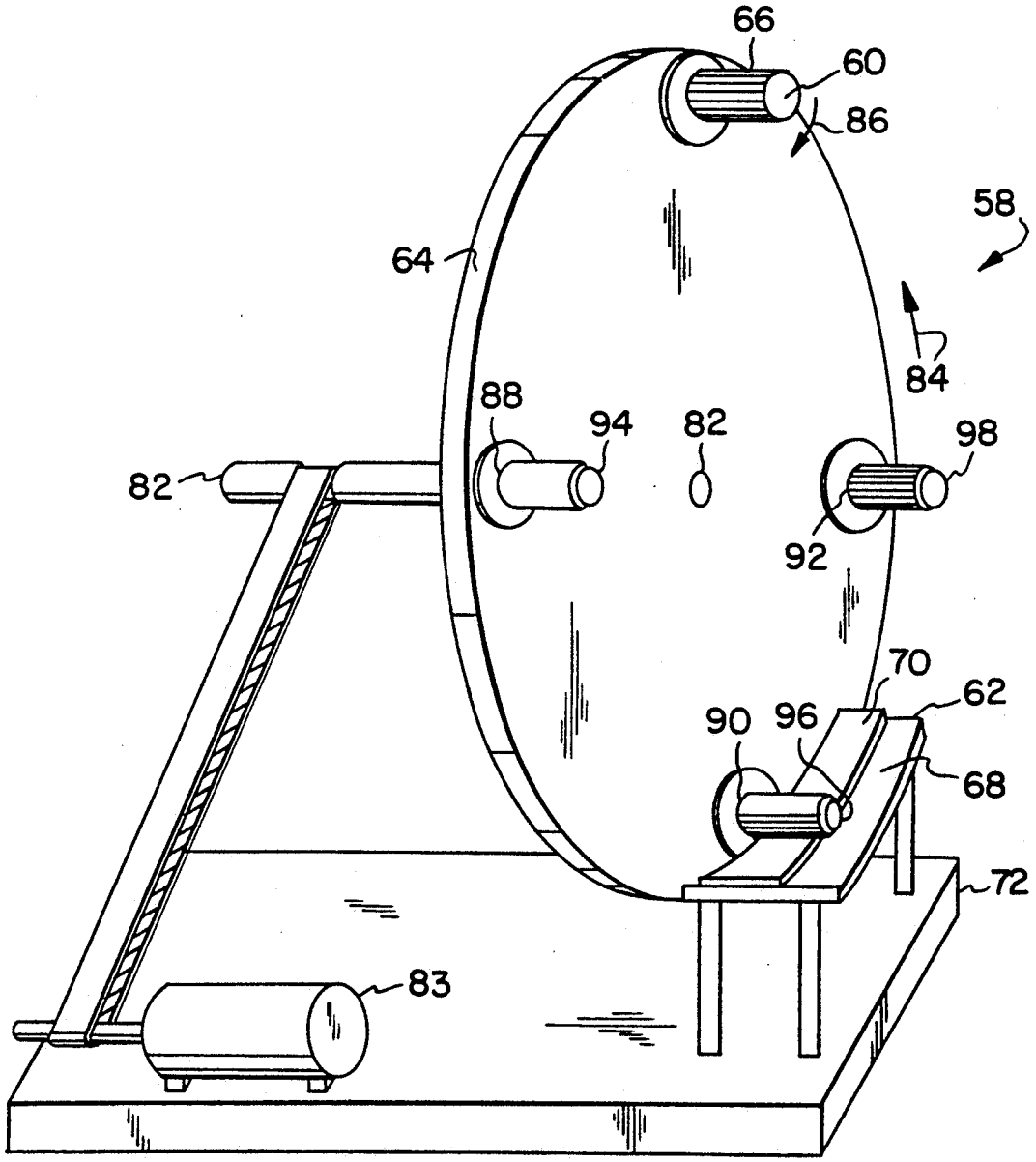
FIGS. 9*a* and 9*b* are a perspective view and a back view, respectively, of one embodiment of the apparatus of the present invention used for reforming the outward bulge, and the sidewall, if desired, in a container.
Figure 9B:
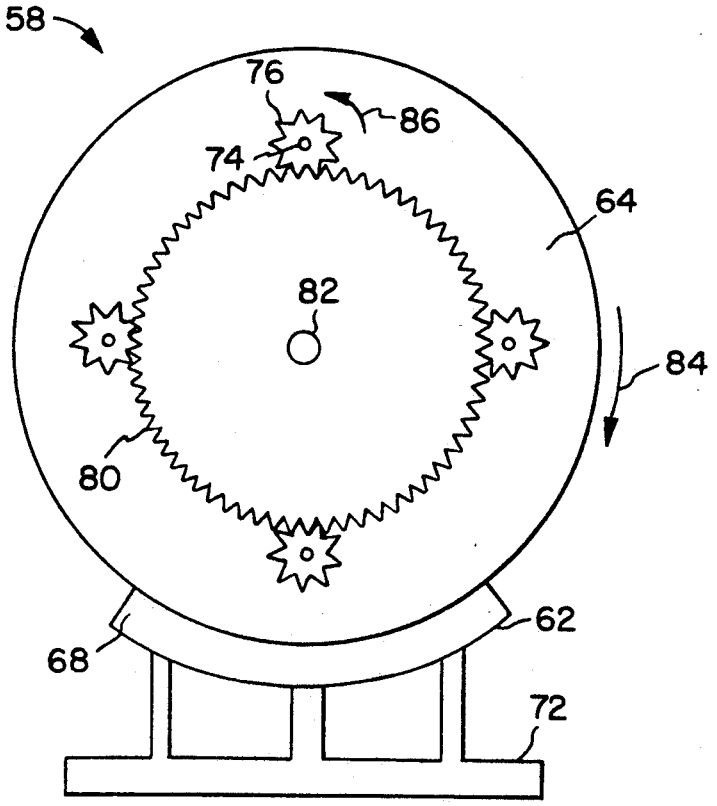

FIGS. 9*a* and 9*b* are front perspective and back views, respectively, of one embodiment of such an apparatus 58 which comprises an inner member, such as a mandrel 60, and an outer member, such as an arcuate member 62, positionable in opposing relation with respect to the inner member and capable of relative radial movement therebetween. In the embodiment illustrated in FIGS. 9*a* and 9*b*, the apparatus 58 also includes a circular turret 64 to which is secured a plurality of mandrels 60, 88, 90, and 92. For purposes of clarity, the turret 64 is shown as having four mandrels; a turret having more or fewer mandrels can also be employed, depending upon production requirements. Container feed and discharge units can also be employed to facilitate production by placing container bodies, such as container body 94, on mandrels, such as the mandrel 88, and by removing container bodies, such as container body 98, from mandrels, such as the mandrel 92, after the bulge has been reformed.

The mandrel 60 has a plurality of alternating inward and outward segments (collectively indicated by reference numeral 66) which correspond in shape, dimension and position to the inward and outward segments to be formed in the container bulge and, if desired, in the container sidewall. As previously described, the inward and outward segments to be formed in the container are not limited to a particular shape but are illustrated in the preferred arcuate shape. If another shape is desired, the segments 66 in the mandrel 60 would have a corresponding shape.

Preferably, the arcuate member 62 includes a rigid plate 68 an overlaying layer or pad of resilient material 70. The rigid plate 68 can be made from a metal, such as aluminum or, preferably, steel, and mounted on a base 72. The resilient material can be a urethane pad having a Durometer in the range of about 70A to about 95A, and preferably about 90A, and a thickness of about ⅛ inch or more, and preferably from about ⅛ inch to about ¼ inch. Other materials, having comparable properties, can also be used. If the resilient material is too thin or too rigid, metal in the area to be reformed may be inadequately forced into the inward segments of the mandrel. If the resilient material is too thick or too soft, it will absorb too much of the compressive force between the mandrel and the rigid plate and the segments may be improperly formed in the container, if formed at all.

The mandrel 60 is connected by a shaft 74 through the turret 64 to a gear 76. The gear 76 cooperates through a series of gears, collectively illustrated and referred to as central gear 80, connected to the turret 64 at a central shaft 82. The turret 64 is powered by a motor 83 or other source of motion. When operating, the motor 83 drives the turret 64 and the central gear 80 in a direction indicated by an arrow 84 (counterclockwise in FIG. 9*a* and clockwise in the back view of FIG. 9*b*); the mandrel gear 76 and the mandrel 60 are driven in the opposite direction, represented by an arrow 86. It can be appreciated that with appropriate gear sets, the other mandrels 88, 90 and 92 rotate in the same direction as the mandrel 60 while the turret 64 revolves about the center shaft 82.

The operation of the reforming apparatus 58 will now be described. In FIG. 9*a*, the empty mandrel 60, the mandrel 88 and container body 94, the mandrel 90 and container body 96, and the mandrel 92 and container body 98 represent successive stages in the sequence by which the bulge is reformed, and the sidewall, if desired. The drawn and ironed container body 94 is mounted on the empty mandrel 88 and remains in place by a vacuum. As the turret 64 revolves in the direction indicated by the arrow 84, the portion of the container 94 to be reformed (i.e., the bulge and, if desired, at least a portion of the sidewall section) comes into compressive contact with the resilient layer 70, as illustrated in FIG. 9*a* by the partially reformed container body 96 on the mandrel 90. As each container body revolves around the center turret shaft 82, each also rotates about its own longitudinal center axis, coinciding with the shaft of the mandrel on which it is mounted. Consequently, the container 96 is made to roll along the resilient layer 70 with substantially no relative linear movement between the resilient layer 70 and the container 96 at the area of contact between the two. Thus, there is substantially no "slippage" to cause the portion of the container being reformed to stretch, bunch up, or otherwise result in defective inward and outward segments. At the area of contact between the container body 96 and the resilient layer 70, the resilient layer 70 deforms and pressure between the mandrel 90 and the resilient layer 70 forces the metal of the container body 96 to conform to the shape of the mandrel 90. In FIG. 9*a*, the container body 96 is shown about halfway through the reforming process. Following completion of the reforming process, as shown by the container body 98 on the mandrel 92, the container body is removed from the mandrel for necking and flanging and a new container body placed on the empty mandrel.

In the embodiment of the apparatus 58 illustrated in FIGS. 9*a* and 9*b*, the resilient layer 70 has a length substantially equal to the circumference of a container body. Preferably, the speed of revolution of the turret 64 about the center turret shaft 82 and, therefore, the speed of revolution of each mandrel about the shaft 82, is jointly selected with the speed of rotation of each mandrel about its longitudinal center axis such that there is no relative linear movement between the portion of the container to be reformed and the resilient layer 70 at the area of contact between the two and to enable each area on the circumference of the bulge to be in contact with the resilient layer 70 only once. Because of slight positioning and speed errors, repeating the reforming process on already formed inward and outward segments tends to cause stretching or bunching of the metal and results in imperfectly formed segments and should, therefore, be avoided.

Figure 10:
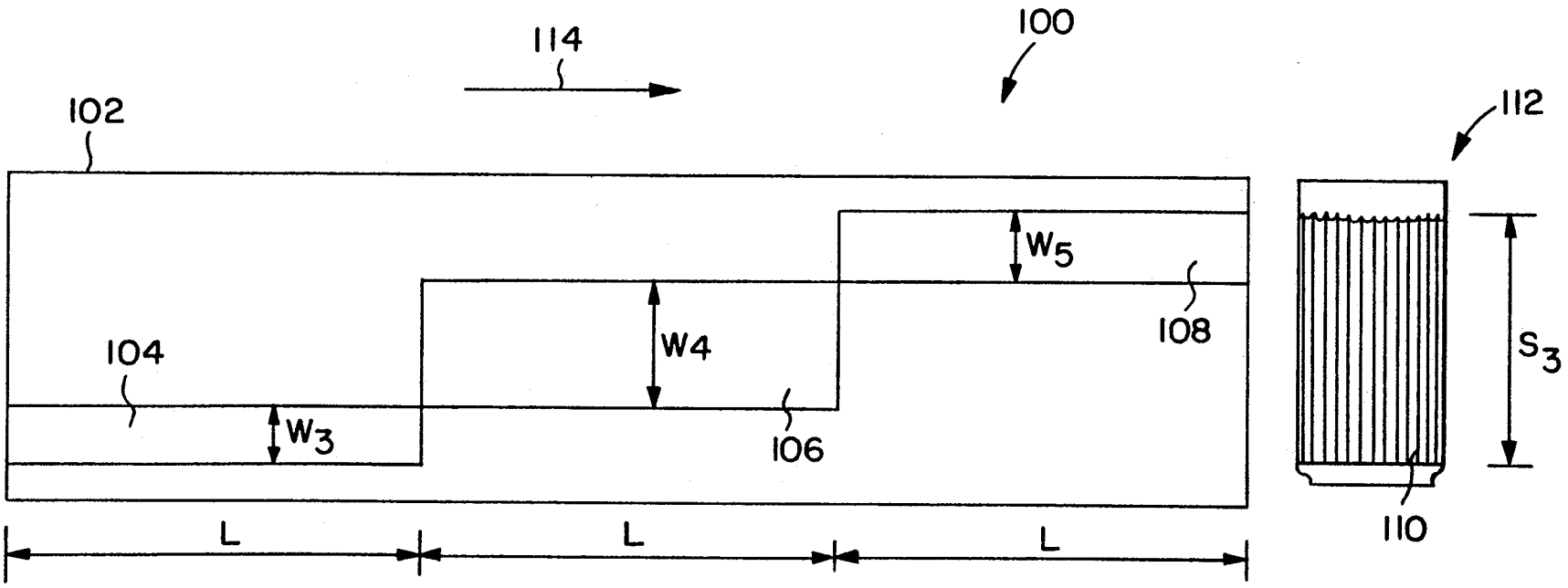
FIG. 10 is a top view of one embodiment of an outer member of the present invention.

FIG. 10 is a top view of another embodiment of an outer member 100. It includes a rigid plate 102, which can be flat or arcuate, and three rectangular sections of overlying resilient material 104, 106, and 108 having widths $w_3$, $w_4$, and $w_5$, respectively. The sum of the widths, $w_3+w_4+w_5$, is substantially equal to the length S: of the inward and outward segments 110 to be formed in a container 112. Furthermore, each resilient section 104, 106 and 108 of the outer member 100 has a length L substantially equal to the circumference of a container 112. The container 112, mounted on an inner member such as a mandrel, is rolled in the direction indicated by the arrow 114 and three different circumferential divisions of the container 112 sequentially come into contact with the resilient sections 104, 106 and 108. If the outer member 100 is substantially flat, the container body 112 can be rolled linearly along the outer member 100. If the outer member 100 is arcuate, the container body 112 can be rolled in an arcuate fashion, such as on a turret device as described in conjunction with FIGS. 9*a* and 9*b*. With either arrangement, a compressive force, having a component substantially vertical to the surface of the outer member 100, is applied between the inner and outer members to reform the stripper bulge and, if desired, portions of the sidewall.

In the embodiment illustrated in FIG. 10, the lowermost division of the inward and outward segments 110 is formed first by contact with the first resilient segment 104; the center division of segments 110 is formed by contact with the second resilient segment 106; and the upper-most division of segments 110 is formed by contact with the third resilient segment 108. It has been found that the multi-section configuration illustrated in FIG. 10 enables the compressive force between a mandrel and the outer member 100, with the container body 112 mounted on the mandrel and positioned between the two, to be reduced from the pressure required if the container 112 was to be reformed in a single pass. Pressures as low as about 1200 pounds per square inch at the area of contact between the container body 112 and the outer member 100 have been found to be satisfactory in the reformation of the container body. Other configurations could permit even lower pressures to be used, reducing stress on the container and on the components of the reforming apparatus. To prevent circumferential gaps between the lower-most and center divisions of the inward and outward segments 110 and between the center and upper-most divisions, the widths $w_3$, $w_4$, and $w_5$ can be selected to provide a small overlap (such as about one-eighth of an inch) between adjacent resilient sections. Additionally, the outer member 100 is not limited to having three sections of resilient material but can, if desired, have another number of such sections.

If desired, the apparatus for reforming the bulge of a container body illustrated in FIGS. 9*a* and 9*b* can include more than one arcuate member spaced about the turret and have separate container feed and discharge units associated with each. Such an arrangement would enable production to be increased without increasing the number of apparatuses.

Figure 11:
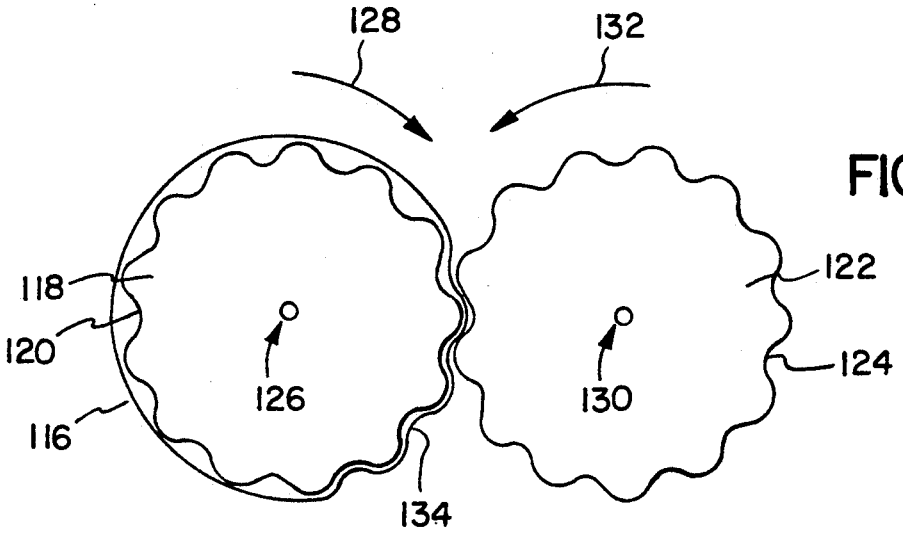
FIG. 11 is a cross-sectional view of an alternative embodiment of the reforming apparatus of the present invention.

FIG. 11 is a cross-sectional view of a portion of an alternative embodiment of the reforming apparatus of the present invention. A container body 116 is placed over a mandrel 118 having inward and outward segments 120 corresponding to inward and outward segments to be formed in the container 116 (arcuate in shape or otherwise). A second mandrel 122 also has inward and outward segments 124 which can engage with the inward and outward segments 120 of the mandrel 118 in a manner similar to the meshing of gears. The mandrel 118 is rotatable about a first axis 126 in a first direction, as indicated by an arrow 128 and second mandrel 122 is rotatable about a second axis 130 in the opposite direction, as indicated by an arrow 132. In operation, the two mandrels 118 and 122 are engaged with a portion of the container 116 therebetween. As the mandrels 118 and 122 rotate in their respective directions 128 and 132, inward and outward segments 134 are formed in the reworked taper section of the container 116 and, if desired, in a portion or substantially all of the sidewall. When the mandrel 118 has completed a full rotation about the axis 126, the reformed container 116 is removed from the mandrel 118, such is by a burst of compressed air through the center of the mandrel 118. To reduce slippage between the container 116 and the second mandrel 122, a layer of resilient material, such as a urethane pad, can overlay the second mandrel 122.

Although the present invention has been described in detail, it should be understood that various changes, substitutions and alterations can be made herein not departing from the spirit and scope of the invention as defined by the claims set forth herein.

What is claimed is:

1. In a drawn and ironed container comprising a cylindrical sidewall section having a first longitudinal center axis and a first radius, a bottom support section having a second radius less than the first radius, and a rework taper section connecting the sidewall section and the bottom section having an annular, outward bulge substantially adjacent to the bottom of the sidewall section, the improvement comprising:

a plurality of alternating inward and outward segments spaced around the circumference of the bulge and extending through at least a portion of the longitudinal extent of the bulge, wherein each of said inward segments has an arcuate shape and has a first radius of curvature measured at the inward-most location in said inward segment, and each of said outward segments has an arcuate shape and has a second radius of curvature measured at the outward-most location in said outward segment, said second radius of curvature being greater than said first radius of curvature.

2. The container of claim 1, wherein said plurality of alternating inward and outward segments extend longitudinally into the sidewall section.

3. The container of claim 1, wherein said plurality of alternating inward and outward segments extend through substantially the entire longitudinal extent of the sidewall section.

4. The container of claim 1, wherein adjacent inward and outward segments abut each other.

5. The container of claim 1, wherein adjacent inward and outward segments are substantially uniformly spaced around the circumference of the bulge.

6. The container of claim 1, wherein each of said outward segments has a second longitudinal center axis, substantially parallel to said first longitudinal center axis and has an oblong shape substantially symmetrical across said second longitudinal center axis.

7. The container of claim 1, wherein each of said outward segments has an arcuate shape and has a substantially constant radius of curvature.

8. A container drawn and ironed from an aluminum alloy having a thickness of about 12.0 mils or less, comprising:

an elongated cylindrical sidewall section having a first longitudinal center axis and a first radius;

an annular bottom support section having a second radius less than the first radius;

a rework taper section extending upwardly and outwardly from said bottom section and connecting said bottom section and said sidewall section, said rework taper section having a thickness which gradually reduces from said bottom section to said sidewall section, and having an annular, outward bulge of a reduced thickness at its upper end adjacent to the lower end of said sidewall section; and a plurality of longitudinally extending inward segments and a plurality of longitudinal extending outward segments alternately spaced around the circumference of said outward bulge and extending through at least an upper portion of the longitudinal extent of said outward bulge, said segments being arranged to increase the minimum column strength of said container and also to reduce the standard deviation of the minimum column strength of a plurality of said containers.

9. The container of claim 8, wherein the container has a thickness of about 11.6 mils.

10. The container of claim 8, wherein adjacent inward and outward segments are substantially uniformly spaced around the circumference of the bulge and abut each other.

11. The container of claim 8, wherein each of said outward segments has an oblong shape symmetrical about a second longitudinal center axis substantially parallel to said first longitudinal center axis.

12. The container of claim 8, wherein:

each of said inward segments has an arcuate shape and has a first radius of curvature measured at the inward-most location in said inward segment; and each of said outward segments has an arcuate shape and has a second radius of curvature measured at the outward-most location in said outward segment, said second radius of curvature being less than said first radius of curvature.

13. The container of claim 8, wherein said plurality of alternating inward and outward segments extend longitudinally into the sidewall section.

14. The container of claim 8, wherein said plurality of alternating inward and outward segments extend through substantially the entire longitudinal extent of the sidewall section.

15. The container of claim 8, wherein adjacent inward and outward segments abut each other.

16. The container of claim 8, wherein each of said outward segments has an arcuate shape and has a substantially constant radius of curvature.

17. A drawn and ironed container, comprising:

a cylindrical sidewall section having a first longitudinal center axis and a first radius;

a bottom support section having a second radius less than the first radius;

a rework taper section connecting said sidewall section and said bottom section, said rework taper section having an annular, outward bulge adjacent to the bottom of said sidewall section; and a plurality of inward segments and a plurality of outward segments alternately spaced around the circumference of said bulge and extending through at least a portion of the longitudinal extent of said bulge, wherein each of said inward segments has an arcuate shape and has a first radius of curvature measured at the inward-most location in said inward segment, and each of said outward segments has an arcuate shape and has a second radius of curvature measured at the outward-most location in said outward segment, said second radius of curvature being less than said first radius of curvature.

18. A plurality of containers drawn and ironed from an aluminum alloy, each comprising:

an elongated cylindrical sidewall section having a first longitudinal center axis and a first radius;

an annular bottom support section having a second radius less than the first radius;

a rework taper section extending upwardly and outwardly from said bottom section and connecting said bottom section and said sidewall section, said rework taper section having a thickness which gradually reduces from said bottom section to said sidewall section, and having an annular, outward bulge of a reduced thickness at its upper end adjacent to the lower end of said sidewall section; and a plurality of longitudinally extending first segments and a plurality of longitudinally extending second segments alternately spaced around the circumference of said outward bulge and extending through at least an upper portion of the longitudinal extent of said outward bulge, said segments being arranged to increase the minimum column strength of said plurality of containers and thereby reduce the standard deviation of the column strength of said plurality of containers.

* * * * *